US010343272B2

(12) United States Patent
Morita et al.

(10) Patent No.: US 10,343,272 B2
(45) Date of Patent: Jul. 9, 2019

(54) IMPACT-DRIVEN TOOL

(71) Applicant: NIPPON PNEUMATIC MANUFACTURING CO., LTD., Osaka-shi (JP)

(72) Inventors: Yuuji Morita, Nabari (JP); Seiichiro Tan, Nabari (JP)

(73) Assignee: NIPPON PNEUMATIC MFG. CO., LTD., Osaka-Shi, Osaka (JP)

( * ) Notice: Subject to any disclaimer, the term of this patent is extended or adjusted under 35 U.S.C. 154(b) by 408 days.

(21) Appl. No.: 15/105,236

(22) PCT Filed: Dec. 18, 2013

(86) PCT No.: PCT/JP2013/083841
§ 371 (c)(1),
(2) Date: Jun. 16, 2016

(87) PCT Pub. No.: WO2015/092875
PCT Pub. Date: Jun. 25, 2015

(65) Prior Publication Data

US 2016/0318166 A1 Nov. 3, 2016

(51) Int. Cl.
*B25D 9/18* (2006.01)
*B25D 9/26* (2006.01)
(Continued)

(52) U.S. Cl.
CPC ..... *B25D 9/18* (2013.01); *B25D 9/26* (2013.01); *E21B 1/00* (2013.01); *E21B 4/06* (2013.01); *B25D 2250/131* (2013.01)

(58) Field of Classification Search
CPC .... B25D 9/18; B25D 9/26; E21B 1/00; E21B 4/06
(Continued)

(56) References Cited

U.S. PATENT DOCUMENTS 3,552,269 A * 1/1971 Arndt ..... B25D 9/26 91/277
4,034,817 A * 7/1977 Okada ..... B25D 9/145 173/207
(Continued)

FOREIGN PATENT DOCUMENTS

AT 345218 B 7/2008
AU 500873 B 6/1979
(Continued)

OTHER PUBLICATIONS

PCT International Written Opinion from PCT/JP2013/083841 dated Mar. 25, 2014, and its English translation.
(Continued)

*Primary Examiner* — Stephen F. Gerrity
*Assistant Examiner* — Katie L Gerth
(74) *Attorney, Agent, or Firm* — Ladas & Parry, LLP

(57) ABSTRACT

An impact-driven tool includes a cylinder and a piston slidably inserted into the cylinder and has a large-diameter portion. The cylinder includes: a chamber on one end side; a chamber on the other end side; a communication path that allows the chamber on one end side and the chamber on the other end side to communicate with each other; and a valve chamber that is continuous with one end side in the axial direction of the communication path, and a valve body for piston lifting control that is incorporated so as to be movable up and down and is provided in the valve chamber.

5 Claims, 13 Drawing Sheets

(51) Int. Cl.
*E21B 1/00* (2006.01)
*E21B 4/06* (2006.01)
*B25D 9/14* (2006.01)

(58) Field of Classification Search
USPC ..... 173/90, 200
See application file for complete search history.

(56) References Cited

U.S. PATENT DOCUMENTS

| | | | | | |
|---|---|---|---|---|---|
| 4,413,687 | A * | 11/1983 | Eklof | B25D 9/12 | 173/207 |
| 4,852,664 | A * | 8/1989 | Terada | B25D 9/12 | 173/206 |
| 4,945,998 | A * | 8/1990 | Yamanaka | B25D 9/145 | 173/207 |
| 5,031,505 | A * | 7/1991 | Campbell | B25D 9/26 | 91/300 |
| 5,117,921 | A * | 6/1992 | Bartels | B25D 9/145 | 173/105 |
| 5,372,196 | A * | 12/1994 | Andersson | B25D 9/145 | 173/112 |
| 6,371,222 | B1 * | 4/2002 | Andersson | B25D 9/145 | 173/136 |
| 2009/0223689 | A1 * | 9/2009 | Birath | B25D 9/18 | 173/13 |

FOREIGN PATENT DOCUMENTS

| | | | |
|---|---|---|---|
| CN | 87216151 | U | 9/1988 |
| CN | 88204592 | U | 12/1988 |
| CN | 2130205 | Y | 4/1993 |
| CN | 1097235 | A | 1/1995 |
| CN | 2360580 | Y | 1/2000 |
| CN | 101927478 | A | 12/2010 |
| CN | 202370426 | U | 8/2012 |
| CN | 102686819 | A | 9/2012 |
| DE | 3103856 | A | 9/1982 |
| DE | 10237407 | A | 4/2004 |
| FR | 2504049 | A1 | 10/1982 |
| JP | S61-2224 | Y2 | 1/1986 |
| JP | H0493185 | | 3/1992 |
| JP | 2003159667 | | 6/2003 |
| JP | 200371744 | | 3/2012 |
| KR | 20040072138 | A | 8/2004 |
| KR | 101176084 | B | 8/2012 |
| KR | 20130086455 | A | 8/2013 |
| WO | 20051/21492 | A1 | 12/2005 |
| WO | 2012026571 | | 3/2012 |

OTHER PUBLICATIONS

PCT International Preliminary Report on Patentability Chapter I from PCT/JP2013/083841 dated Jun. 21, 2016, and its English translation.

International Search Report for PCT/JP2013/083841 dated Mar. 25, 2014 and its English translation provided by WIPO.

From CN 201380081538.3, First Office Action, dated Jun. 28, 2017, with an English translation from Espacenet Global Dossier.

* cited by examiner

IMPACT-DRIVEN TOOL

CROSS-REFERENCE TO RELATED APPLICATIONS

This application is the U.S. National Stage of International Patent Application No. PCT/JP2013/083841 filed on Dec. 18, 2013, the disclosure of which is hereby incorporated by reference in its entirety.

FIELD

The present invention relates to an impact-driven tool such as a hydraulic breaker used for dismantling concrete structures, fracturing rocks, drilling bedrock, and the like.

BACKGROUND

In an impact-driven tool configured so that a piston having a large-diameter portion is slidably fitted into a cylinder, an upper chamber is provided above the large-diameter portion of the piston, a lower chamber is provided below the large-diameter portion, the piston is raised by supplying a pressure oil into the lower chamber, a high-pressure gas in a gas chamber formed above the piston is compressed during the rising process to store the energy, and the piston is lowered by the energy derived from expansion of the above-described gas to strike the upper end of a chisel located below the piston, a switching valve is actuated in conjunction with the upward and downward movement of the piston, and the upward and downward movement of the piston is controlled by the switching valve.

Switching valves, which are employed for such an impact-driven tool, include a spool type in which the valve body is in the form of a round shaft, an annular groove is formed in the outer circumference of the valve body, the annular groove is displaced in the axial direction by the upward and downward movement of the valve body, and the flow channels of a hydraulic oil are thereby switched, as disclosed in Patent Literature 1, and a cylindrical type in which a hydraulic oil flows thereinside, as disclosed in Patent Literature 2.

CITATION LIST

Patent Literature

Patent Literature 1: Japanese Examined Utility Model Application Publication No. S61-2224 Y
Patent Literature 2: JP 2003-71744 A

SUMMARY

Technical Problem

Meanwhile, in the switching valve disclosed in Patent Literature 1, a plurality of annular grooves such as an annular groove that introduces the hydraulic oil from an oil supply opening into the lower chamber during the rise stop state of the valve body and an annular groove that introduces the hydraulic oil from the oil supply opening into the upper chamber during the descent stop state need to be provided at intervals in the axial direction of the valve body, and therefore the total length of the switching valve is increased in order to maintain sufficient flow channels, which causes an increase in size and weight, resulting in an inconvenience that the control of the switching valve is rendered difficult.

Further, during the striking process in which the piston descends, the hydraulic oil flows along the annular grooves formed in the valve body when the hydraulic oil flows from the lower chamber to the upper chamber or the oil discharge opening, and the annular grooves limit the flow rate. Therefore, the flow resistance is increased to inhibit smooth flow of the hydraulic oil, and the striking efficiency of the piston is reduced. If the diameter of the valve body is increased to form deep annular grooves, and the length of the stroke is increased, for the purpose of improving the striking efficiency, the length and weight of the valve body are both increased, and the motion of the valve body lacks smoothness, thereby making the control of the valve body difficult.

Further, the machining accuracy of the groove portions needs to be enhanced so as not to hinder the sliding of the valve body, and therefore the fabrication is time consuming.

On the other hand, in the switching valve disclosed in Patent Literature 2, since the hydraulic oil in the lower chamber flows into the inside through the lower end opening of the valve body to flow into the upper chamber through a plurality of small diameter holes formed on the top during the striking process of the piston, the inner diameter of the valve body needs to be increased, in order to maintain sufficient flow channels for such flow and to enhance the fluidity of the hydraulic oil. The increase in inner diameter causes an increase in outer diameter, therefore causing an increase in size and weight of the valve body and making oil leakage likely to occur, which unstabilizes the actuation of the valve body and makes actuation failure likely to occur, resulting in an inconvenience that the actuation efficiency of the impact-driven tool is reduced.

Further, when the hydraulic oil swiftly flows from the upper chamber to the lower chamber due to the recoil imparted to the piston immediately after the chisel is struck, the hydraulic oil flows downward thereinside from the top of the valve body passing through the small diameter holes, and therefore a downward pressing force is applied to the valve body to unstabilize the actuation and to affect the control of the piston, which may possibly cause so-called "uneven striking" in which the striking force and the number of strikes on the chisel of the piston are unstabilized (or made uneven).

It is an object of the present invention to provide an impact-driven tool that enables sufficient conduits for a hydraulic oil to be maintained, while the length in the axial direction and the diameter of a valve body in a switching valve are reduced.

Solution to Problem

In order to solve the above-described problems, the present invention employs a configuration in which an impact-driven tool includes: a cylinder that has an elongated shape from one end to the other end and that is open on the other end side; a chisel having one end portion that is slidably inserted into the other end portion of the cylinder; and a piston that is incorporated in the cylinder so as to be slidable in the axial direction and that has a large-diameter portion at an intermediate position between its one end portion and the other end portion in the axial direction to strike the chisel with the other end portion, wherein the cylinder includes: a chamber on one end side that is a space defined by an outer surface of the piston located more on the one end side in the axial direction than the large-diameter portion of the piston and an inner surface of the cylinder; a chamber on the other end side that is a space defined by an outer surface of the piston located more on the other end side in the axial direction than the large-diameter portion of the piston and an inner surface of the cylinder; a gas chamber in which a high-pressure gas is encapsulated on the one end surface side in the axial direction of the piston; a communication path that allows the chamber on one end side and the chamber on the other end side to communicate with each other; a valve chamber that is continuous with one end side in the axial direction of the communication path; and a valve regulating chamber provided on one end side in the axial direction of the valve chamber, and the impact-driven tool includes a valve body that is provided for opening and closing control of the communication path and that is slidably incorporated in the valve chamber, in which a large-diameter portion that is slidable in the axial direction within a large-diameter chamber that is a space on the one end side in the axial direction of the valve chamber is formed on the one end side in the axial direction, the cylinder includes: an oil supply passage for piston movement in one direction that introduces a pressure oil from an oil supply opening to the communication path when the valve body is located at a position on the other end side in the axial direction; a pressure applying passage that guides the pressure oil from the oil supply opening to the valve regulating chamber so as to apply an oil supply pressure onto the one end surface in the axial direction of the valve body; a valve switching control oil passage that moves the valve body when the piston is in a state just before it reaches a movement limit position on the one end side in the axial direction by introducing the pressure oil to a bottom part that is a part on the other end side in the axial direction of the large-diameter chamber during a process in which the piston moves from the other end side to the one end side in the axial direction; and an oil discharge passage that allows the one end side in the axial direction of the large-diameter chamber and an oil discharge opening to communicate with each other when the valve body has moved to the other end side in the axial direction, the communication path has a vertical hole extending in the axial direction, the vertical hole has one end in the axial direction through which the other end portion in the axial direction of the valve body that reciprocates within the valve chamber is movable back and forth, and entry of the other end portion of the valve body into the one end portion of the vertical hole produces a closed state where the communication between the chamber on one end side and the chamber on the other end side is blocked.

In the impact-driven tool according to the present invention, the configuration may be such that the oil supply passage for piston movement in one direction includes: an annular high-pressure in-port formed in the inner circumference of the valve chamber to communicate with the oil supply opening; an annular high-pressure out-port that communicates with the high-pressure in-port via a constricted portion formed in the valve body, when the valve body has moved to the other end side in the axial direction; and a bypass passage that allows the high-pressure out-port and an intermediate portion in the axial direction of the communication path to communicate with each other. In this case, the configuration may be such that the valve switching control oil passage includes: an annular in-port for valve control formed in the inner circumference of the cylinder between the chamber on one end side and the chamber on the other end side, so as to communicate with the chamber on the other end side when the piston is located at a position just before it reaches the movement limit position on the one end side in the axial direction; and an oil passage for valve movement in one direction having one end communicating with the in-port for valve control and the other end communicating with the bottom part of the large-diameter chamber of the valve chamber.

Further, the configuration may be such that the oil supply passage for piston movement in one direction includes an inlet side passage having an open end serving as the oil supply opening, and the valve switching control oil passage includes: an annular in-port for valve control formed in the inner circumference of the cylinder between the chamber on one end side and the chamber on the other end side, so as to communicate with the chamber on the other end side when the piston is located at a position just before it reaches the movement limit position on the one end side in the axial direction; and an out-port for valve control formed at an interval more on the one end side in the axial direction than the in-port for valve control, so as to communicate with the in-port for valve control via the annular groove for valve switching formed in the large-diameter portion of the piston when the piston has moved to the other end side in the axial direction; an oil passage for valve movement in one direction having one end communicating with the in-port for valve control and the other end communicating with the bottom part of the large-diameter chamber of the valve chamber; an oil passage for valve movement in the other direction having one end communicating with the out-port for valve control and the other end constantly communicating with the oil discharge opening via the constricted portion formed in the valve body; and an oil passing hole formed in the valve body so as to allow the part on the other end side of the large-diameter chamber of the valve chamber and the communication path to communicate with each other when the valve body has moved to the one end side in the axial direction.

In this regard, the constricted portion formed in the valve body may be an annular groove or a plurality of cutouts formed at intervals in the circumferential direction.

DESCRIPTION OF EMBODIMENTS

Figure 1:
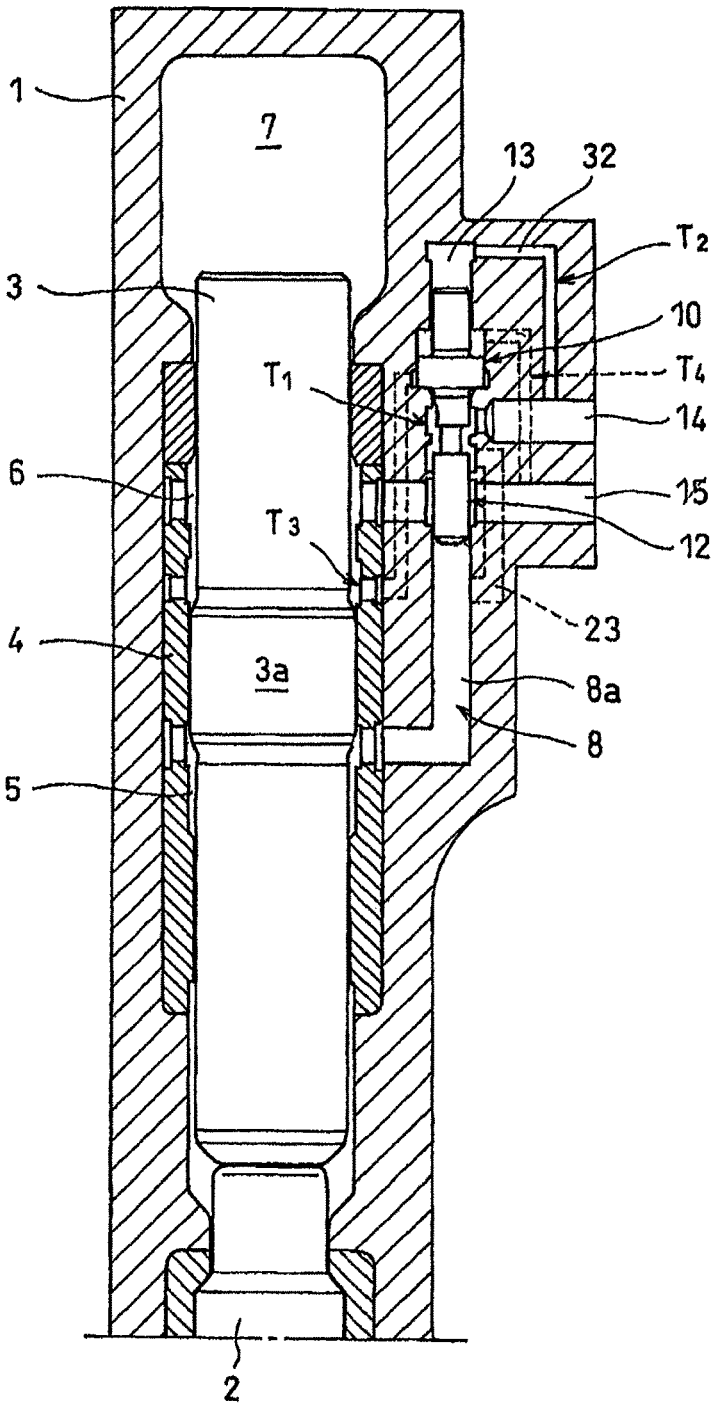
FIG. 1 is a vertical sectional view showing one embodiment of an impact-driven tool according to the present invention.
Figure 2:
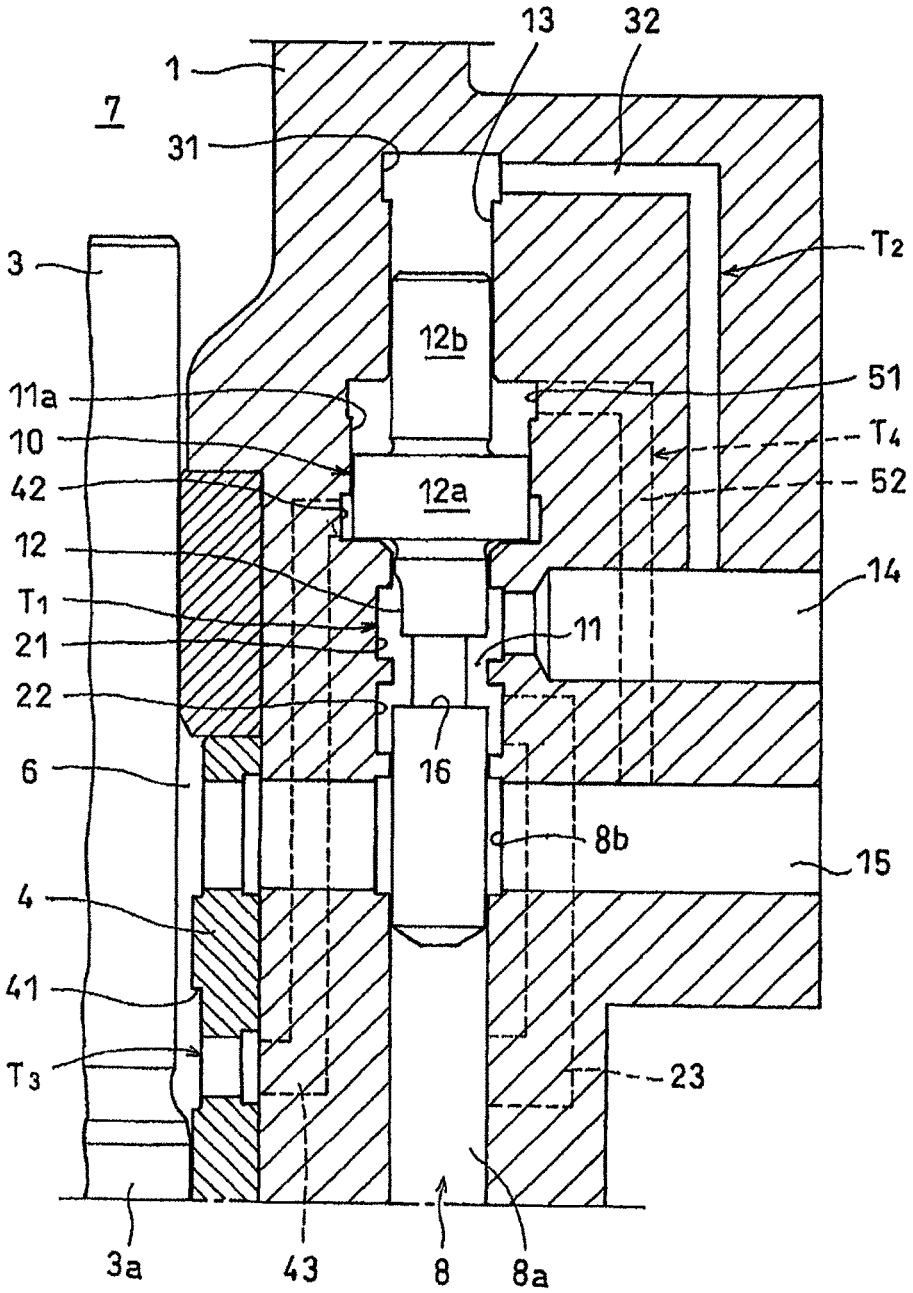
FIG. 2 is an enlarged sectional view showing a switching valve in FIG. 1.

Hereinafter, one embodiment of the present invention will be described with reference to FIGS. 1 to 5. As shown in FIG. 1 and FIG. 2, an impact-driven tool according to the one embodiment includes an elongated cylinder 1 that is open at its lower end, a chisel 2 having an upper end portion inserted into the lower end portion of the cylinder 1 so as to be slidable in the axial direction, and a piston 3 incorporated in the cylinder 1 so as to be slidable in the axial direction and having a large-diameter portion 3*a* at an intermediate position in the axial direction so as to strike the chisel 2 with its lower end portion. Hereinafter, the axial direction has the same meaning as the vertical direction in this embodiment. Further, in this embodiment, a direction on one end side of the axial direction (one side) is the upper side, and a direction on the other end side of the axial direction (the other side) is the lower side.

Specifically, in the impact-driven tool, the upper part of the chisel 2 is fitted into the lower end portion of the cylinder 1 so as to be slidable in the vertical direction. The piston 3 and a sleeve 4 configured to guide the piston 3 to slide are incorporated in the cylinder 1 above the chisel 2. The sleeve 4 forms a part of the cylinder 1 by being positioned in the axial direction.

The piston 3 has the large-diameter portion 3*a* at an intermediate position (at the center in this embodiment) between the upper end portion and the lower end portion in the axial direction. In the cylinder 1, a lower chamber 5 as a chamber on the other end side is provided on the lower surface side of the large-diameter portion 3*a*, and an upper chamber 6 as a chamber on one end side is provided on the upper surface side of the large-diameter portion 3*a*. The lower chamber 5 is an annular space defined by an inner surface of the cylinder 1 and an outer surface of the piston 3 located more on the lower surface side in the vertical direction than the large-diameter portion 3*a* of the piston 3. The upper chamber 6 is an annular space defined by an inner surface of the cylinder 1 and an outer surface of the piston 3 located more on the upper surface side in the vertical direction than the large-diameter portion 3*a* of the piston 3. Further, a gas chamber 7 is provided on the upper end surface side of the piston 3 in the upper part within the cylinder 1, and a high-pressure gas is encapsulated in the gas chamber 7.

The lower chamber 5 and the upper chamber 6 communicate with each other through a communication path 8 formed in the cylinder 1. The communication path 8 has a vertical hole 8*a* extending in the vertical direction, and a switching valve 10 that controls the upward and downward movement of the piston 3 is provided above the vertical hole 8*a*.

The switching valve 10 has a valve body 12 that is incorporated in a valve chamber 11 provided continuously with the upper side of the vertical hole 8*a* of the communication path 8 so as to be movable up and down and that is configured to control the upward and downward movement of the piston 3 by the upward and downward movement of the valve body 12.

The lower end portion of the valve chamber 11 communicates with the upper end portion of the communication path 8. The valve body 12 incorporated in the valve chamber 11 has a large-diameter portion 12*a* in its upper part. The large-diameter portion 12*a* is movable up and down within a large-diameter chamber 11*a* that is an upper part of the valve chamber 11. The lower surface of the large-diameter portion 12*a* abuts the bottom surface of the large-diameter chamber 11*a*, thereby regulating the lowered position of the valve body 12 (the lower limit position that is the movement limit position on the other side), so that the lower end portion of the valve body 12 enters the communication path 8 at the lowered position of the valve body 12 so as to close the communication path 8. The closing of the communication path 8 blocks the communication between the lower chamber 5 and the upper chamber 6.

Further, the upper end surface of the large-diameter portion 12*a* abuts the upper surface of the large-diameter chamber 11*a*, thereby regulating the raised position of the valve body 12 (the upper limit position that is the movement limit position on one side). At the raised position of the valve body 12, the lower end portion of the valve body 12 comes out of the communication path 8 to open the communication path 8, and the lower chamber 5 and the upper chamber 6 are kept in communication with each other.

On the upper end surface of the large-diameter portion 12*a* of the valve body 12, a plunger 12*b* having a diameter smaller than the large-diameter portion 12*a* is integrally provided continuously therewith, and the upper end portion of the plunger 12*b* is slidably inserted into a valve regulating chamber 13 provided above the large-diameter chamber 11*a*.

Further, the cylinder 1 has an oil supply opening 14 provided on a side of the valve chamber 11 and an oil discharge opening 15 provided below the oil supply opening 14.

Further, the cylinder 1 has an oil supply passage for piston rise T1 that introduces a hydraulic oil (pressure oil) to which the pressure from the oil supply opening 14 has been applied into the communication path 8 at the lowered position of the valve body 12, a pressure applying passage T2 that guides the pressure oil from the oil supply opening 14 to a valve regulating chamber 13 so as to constantly apply an oil supply pressure onto the upper end surface of the valve body 12, a valve switching control oil passage T3 that raises the valve body 12 by introducing the pressure oil into the bottom part of the large-diameter chamber 11*a* during the rising process of the piston 3 when the piston 3 is in the state just before it reaches the upper limit position, and an oil discharge passage T4 that allows the upper part of the large-diameter chamber 11*a* and the oil discharge opening 15 to communicate with each other in the lowered state of the valve body 12.

The oil supply passage for piston rise T1 has an annular high-pressure in-port 21 formed in the inner circumference of the valve chamber 11 to communicate with the oil supply opening 14, an annular high-pressure out-port 22 that communicates with the high-pressure in-port 21 via a constricted portion 16 formed in the valve body 12, in the lowered state of the valve body 12, and a bypass passage 23 having one end communicating with the high-pressure out-port 22 and the other end communicating with an intermediate portion of the communication path 8. The constricted portion 16 formed in the valve body 12 is constituted by an annular groove in this embodiment.

The pressure applying passage T2 has an annular pilot port 31 formed in an upper part in the inner circumference of the valve regulating chamber 13, and a pilot hole 32 having one end communicating with the pilot port 31 and the other end communicating with the oil supply opening 14.

The valve switching control oil passage T3 has an annular in-port for valve control 41 formed in the inner circumference of the cylinder between the lower chamber 5 and the upper chamber 6, so as to communicate with the lower chamber 5 when the piston 3 is located at a position just before it reaches the upper limit position, an annular out-port for valve control 42 formed in the bottom part in the inner circumference of the large-diameter chamber 11*a* of the valve chamber 11, and an oil passage for valve rise 43 having one end communicating with the in-port for valve control 41 and the other end communicating with the out-port for valve control 42.

The oil discharge passage T4 has an oil discharge port 51 formed in an upper part in the inner circumference of the large-diameter chamber 11*a,* and an oil discharge hole 52 having one end communicating with the oil discharge port 51 and the other end communicating with the oil discharge opening 15.

An annular groove 8*b* is formed in the inner circumference of the communication path 8 at a position that is opposed to the lower end portion of the valve body 12 when the valve body 12 is located at the lowered position. The annular groove 8*b* communicates with the oil discharge opening 15.

The impact-driven tool shown as the one embodiment is formed by the above-described structure. FIG. 2 shows the state where the piston 3 descends, and the valve body 12 of the switching valve 10 descends so that its lower end portion enters the vertical hole 8*a* of the communication path 8, thereby blocking the communication between the lower chamber 5 and the upper chamber 6. Further, the high-pressure in-port 21 and the high-pressure out-port 22 of the oil supply passage for piston rise T1 communicate with each other through the constricted portion 16 formed in the valve body 12.

In the lowered state of the valve body 12 as described above, when the pressure oil is supplied to the oil supply opening 14, the pressure oil flows from the oil supply passage for piston rise T1 via the bypass passage 23 through the communication path 8 into the lower chamber 5, so that the piston 3 rises. Further, following the rise of the piston 3, the hydraulic oil in the upper chamber 6 flows through the annular groove 8*b* formed in the upper part of the communication path 8 to the oil discharge opening 15, so as to be discharged.

In the rising process of the piston 3 as described above, the high-pressure gas in the gas chamber 7 formed above the piston 3 is further compressed so that the energy thereof is stored.

Figure 3:
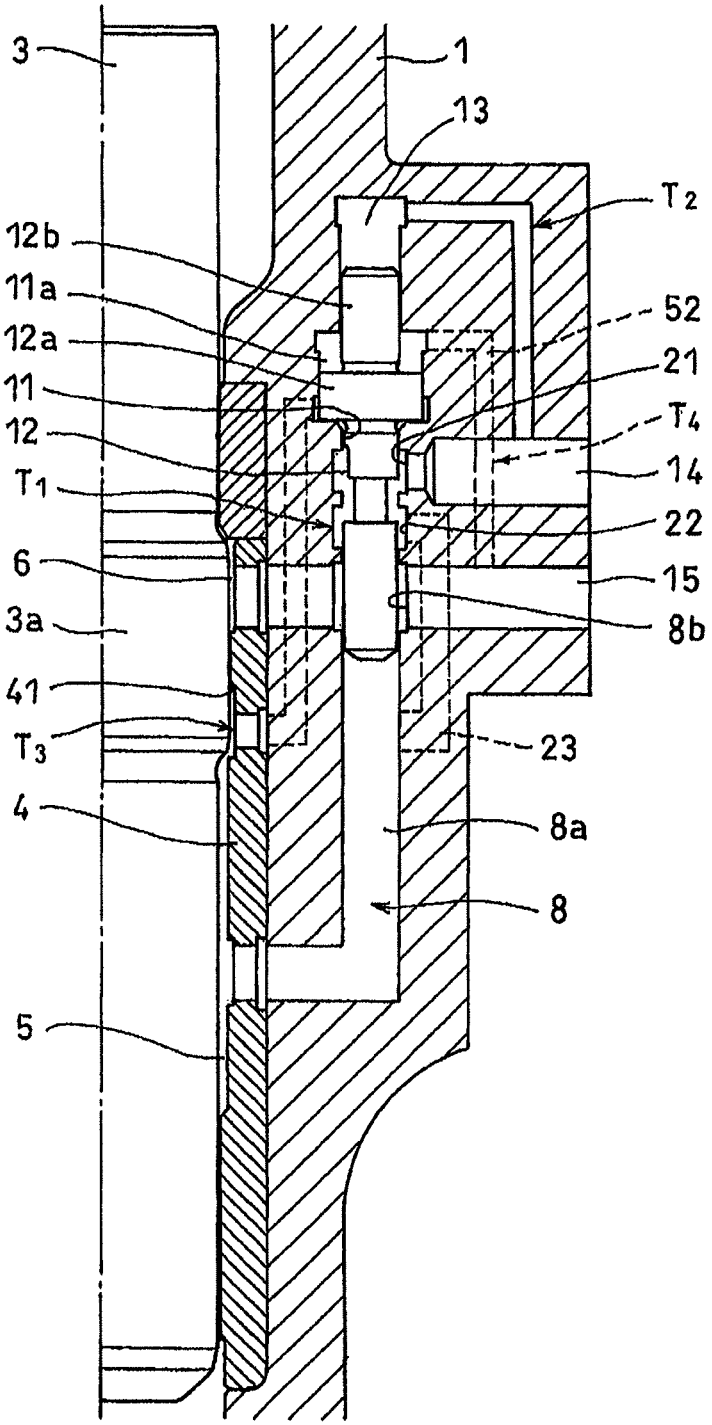
FIG. 3 is a sectional view showing the state where a piston is raised to the upper limit position.

FIG. 3 shows the state where the piston 3 has risen to the upper limit position. When the piston 3 is located at a position just before it reaches the upper limit position, the lower chamber 5 communicates with the in-port for valve control 41 of the valve switching control oil passage T3. This communication allows the hydraulic oil in the lower chamber 5 to flow through the valve switching control oil passage T3 into the lower part of the large-diameter chamber 11*a* of the valve chamber 11. The valve body 12 is raised by the pressing force applied onto the lower surface of the large-diameter portion 12*a* of the valve body 12, so that the hydraulic oil in the large-diameter chamber 11*a* is discharged through the oil discharge passage T4 out of the oil discharge opening 15.

Figure 4:
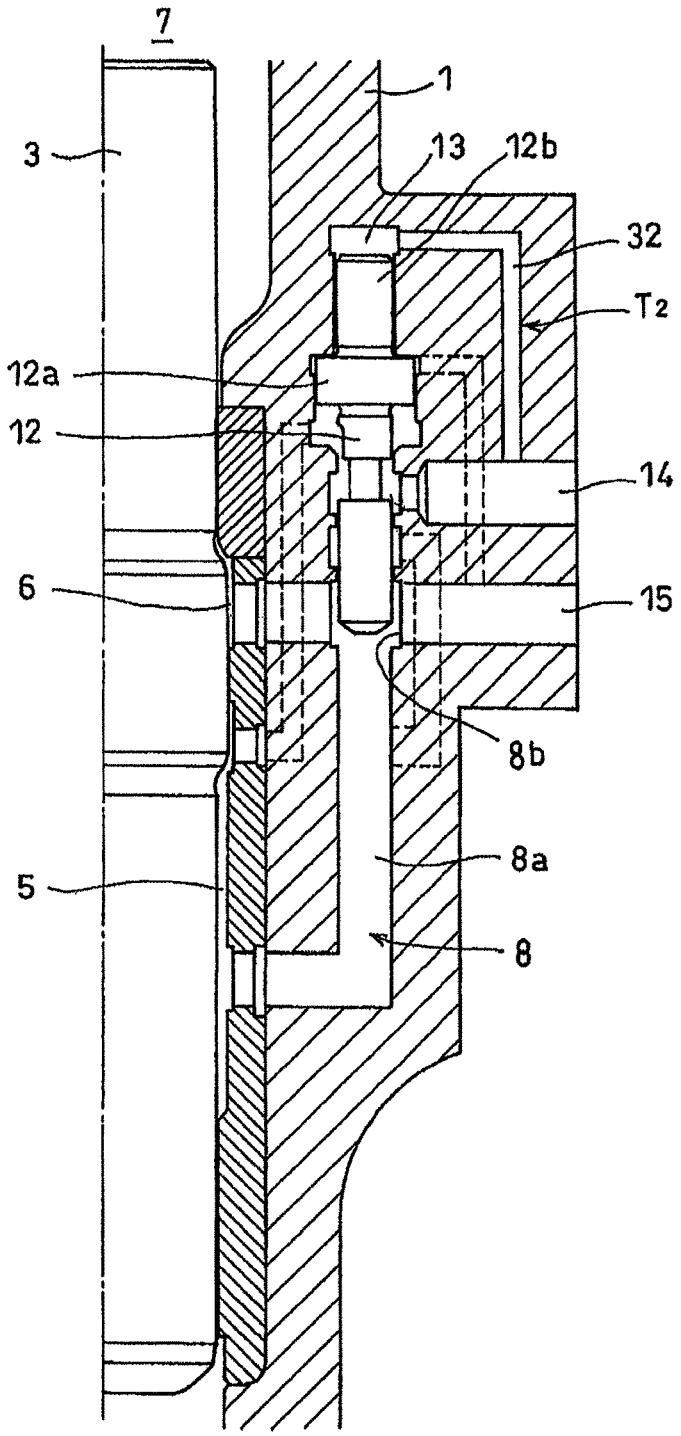
FIG. 4 is a sectional view showing a switching state of the switching valve.

FIG. 4 shows the state where the valve body 12 has risen to the upper limit position. The valve body 12 rises in this way, thereby allowing the lower end portion of the valve body 12 to come out of the communication path 8 through the vertical hole 8*a,* and the opening of the communication path 8 allows the lower chamber 5 to communicate with the oil discharge opening 15 via the communication path 8, resulting in a low pressure of the lower chamber 5. At this time, as the compressed high-pressure gas in the gas chamber 7 expands, the piston 3 rapidly descends.

Figure 5:
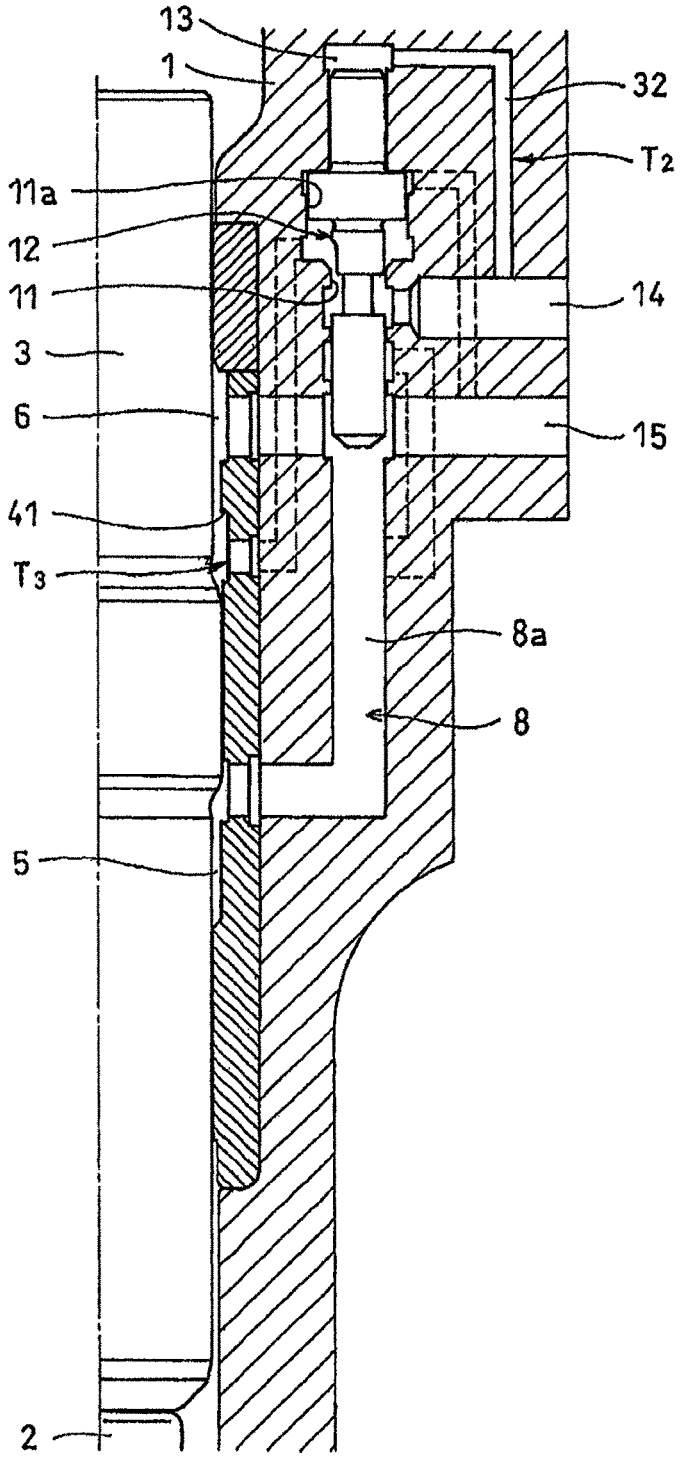
FIG. 5 is a sectional view showing the lowered state of the piston.

The rapid descent of the piston 3 causes the piston 3 to strike the upper end of the chisel 2, as shown in FIG. 5. At this time, the hydraulic oil in the lower chamber 5 mostly flows through the communication path 8 into the upper chamber 6 to prevent the upper chamber 6 from having a negative pressure, so as to smoothen the downward movement of the piston 3.

The piston 3 descends in this way, thereby allowing the upper chamber 6 to communicate also with the oil discharge opening 15 via the annular groove 8*b* in the upper part of the communication path 8. Further, the in-port for valve control 41 communicates with the upper chamber 6, and therefore the lower part of the large-diameter chamber 11*a* communicates with the oil discharge opening 15 via the valve switching control oil passage T3, as a result of which the valve body 12 descends due to the pressing force applied onto the upper end surface of the valve body 12 by the pressure oil supplied from the oil supply opening 14 via the pressure applying passage T2 to the valve regulating chamber 13. Such descent causes the lower end portion of the valve body 12 to enter the communication path 8 so as to close the communication path 8, thereby blocking the communication between the lower chamber 5 and the upper chamber 6, as shown in FIG. 1 and FIG. 2. Thereafter, the above-described motions are repeated.

As shown in this embodiment, the vertical hole 8*a* of the communication path 8 that allows the lower chamber 5 and the upper chamber 6 to communicate with each other is configured to be opened and closed by the rod-shaped lower end portion of the valve body 12 moving up and down within the valve chamber 11, so that the hydraulic oil in the lower chamber 5 flows from the communication path 8 into the upper chamber 6 when the vertical hole 8*a* is opened, which therefore eliminates the need to form a constricted portion such as an annular groove that allows the hydraulic oil in the lower chamber 5 to flow into the upper chamber 6 in the valve body 12, as is needed in conventional techniques, so that the axial length of the valve body 12 can be shortened. Further, as compared with a type using the inside of a hollow valve body as a flow channel, the valve body 12 does not cause a resistance when the hydraulic oil flows from the lower chamber 5 into the upper chamber 6, and further the outer diameter of the valve body 12 can be reduced. The reduction in length and diameter of the valve body 12 enables conduits of the hydraulic oil with sufficient flow channels to be maintained while the weight of the valve body 12 is reduced.

Further, the reduction in length of the valve body 12 enables a reduction in lifting stroke of the valve body 12, and switching of the valve body 12 can be controlled rapidly and reliably, since the valve body 12 is lightweight. Further, the valve body 12 can have a small diameter, and therefore the striking efficiency can be improved by suppressing the actuation failure of the switching valve 10 due to oil leakage during actuation or the reduction in actuation efficiency.

When the piston 3 strikes the chisel 2, the piston 3 suddenly rises due to recoil caused by the striking, and the hydraulic oil in the upper chamber 6 instantaneously flows toward the lower chamber 5. Also at this time, the hydraulic oil reaches the lower chamber 5 directly through a communication path, unlike in conventional techniques, without passing through the inside of the valve body 12 or an annular groove, and therefore the valve body 12 is not affected by the flow of the hydraulic oil, so that the striking by the piston 3 can be stabilized.

Figure 6:
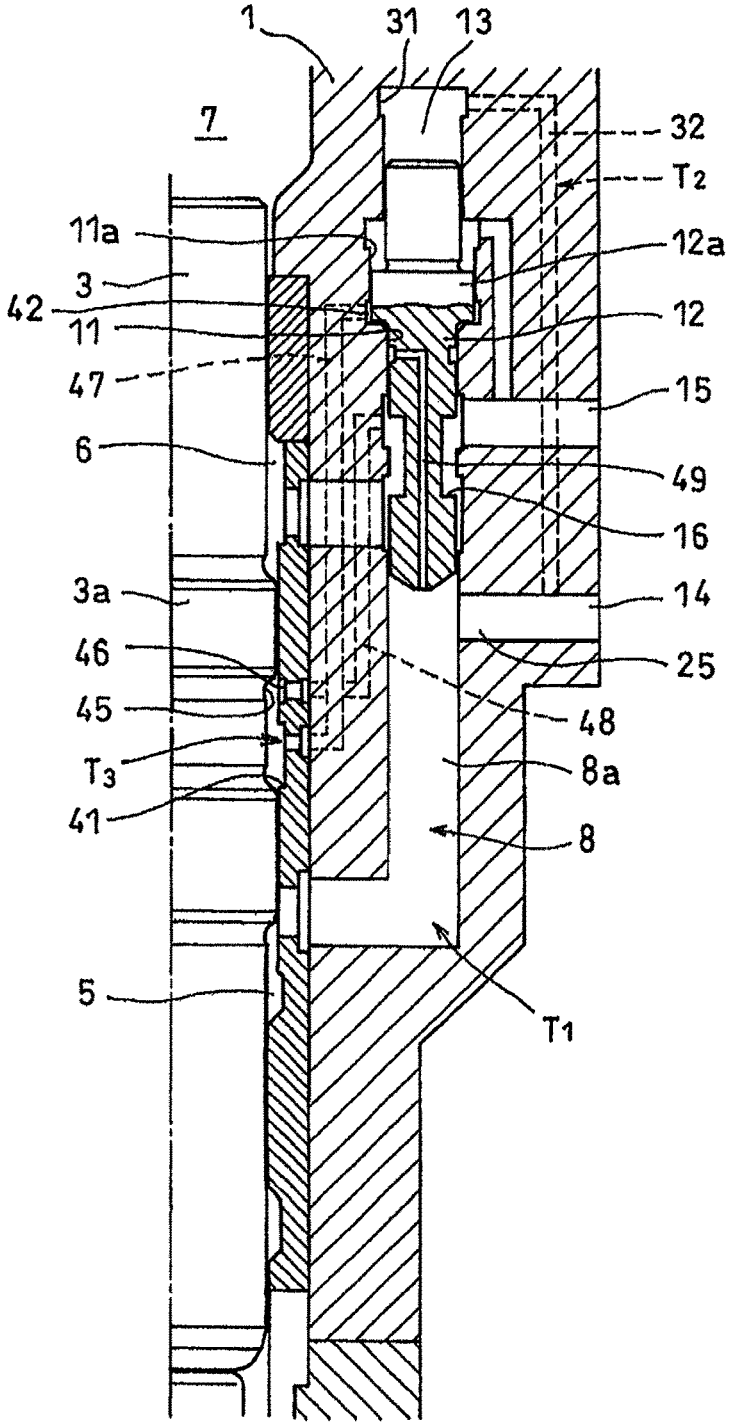
FIG. 6 is a vertical sectional view showing another embodiment of the impact-driven tool according to the present invention.
Figure 7:
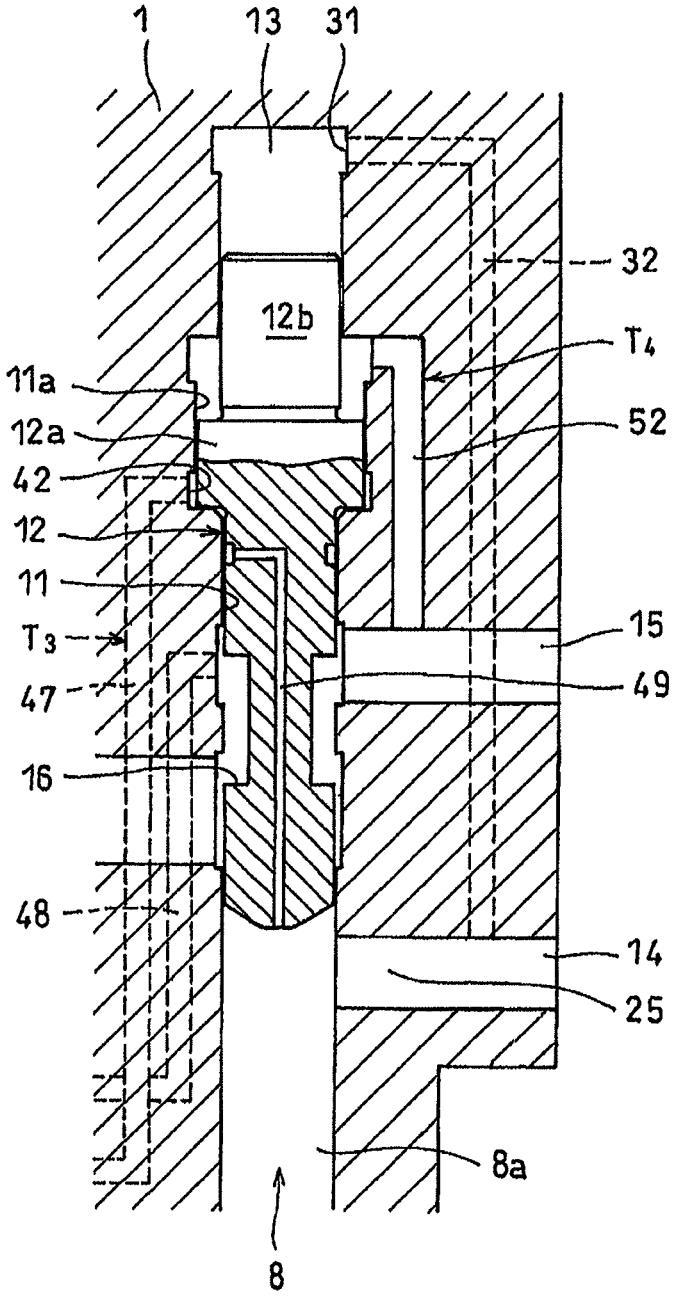
FIG. 7 is an enlarged sectional view showing a switching valve in FIG. 6.

FIG. 6 and FIG. 7 show another embodiment of the impact-driven tool according to the present invention. The impact-driven tool shown as the other embodiment is different from the impact-driven tool of the one embodiment shown in FIG. 1 and FIG. 2, in that the positions of the oil supply opening 14 and the oil discharge opening 15 are vertically reversed, the oil supply passage for piston rise T1 is formed only by the communication path 8 and the inlet side passage 25 having an open end serving as the oil supply opening 14, and the valve switching control oil passage T3 has the following configuration. Therefore, the same parts as in the one embodiment shown in FIG. 1 and FIG. 2 are denoted by the same reference numerals, and the descriptions thereof are omitted.

The valve switching control oil passage T3 shown as the other embodiment in FIG. 6 and FIG. 7 has an annular in-port for valve control 41 formed in the inner circumference of the cylinder between the lower chamber 5 and the upper chamber 6, so as to communicate with the lower chamber 5 when the piston 3 is located at a position just before it reaches the upper limit position, an out-port for valve control 46 that is formed above the in-port for valve control 41 at an interval therefrom and that communicates with the in-port for valve control 41 via an annular groove for valve switching 45 formed in the large-diameter portion 3*a* of the piston 3 when the piston 3 is lowered, an oil passage for valve rise 47 having one end communicating with the above-described in-port for valve control 41 and the other end communicating with the out-port for valve control 42 in the lower part of the large-diameter chamber 11*a*, an oil supply passage for valve descent 48 having one end communicating with the out-port for valve control 46 on the inner circumference side of the cylinder and the other end constantly communicating with the oil discharge opening 15 via the constricted portion 16 formed in the valve body 12, and an oil passing hole 49 with a small diameter that is formed in the valve body 12 and allows the lower part of the large-diameter chamber 11*a* and the communication path 8 to communicate with each other when the valve body 12 is raised.

In the impact-driven tool having the above-described configuration, when the pressure oil is supplied to the oil supply opening 14 in the state where the piston 3 and the valve body 12 are each at the lowered position, the pressure oil flows from the communication hole 8 into the lower chamber 5, and the piston 3 rises.

At this time, the hydraulic oil in the upper chamber 6 flows from the upper part of the communication path 8 into the valve chamber 11 and flows in the periphery of the constricted portion 16 of the valve body 12 to be discharged through the oil discharge opening 15, so that the piston 3 smoothly rises.

When the piston 3 has risen close to the upper limit position, the lower chamber 5 communicates with the in-port for valve control 41, and the hydraulic oil in the lower chamber 5 flows into the valve switching control oil passage T3 and further into the lower part of the large-diameter chamber 11*a* of the valve chamber 11, so that an upward pressing force is applied onto the lower surface of the large-diameter portion 12*a* of the valve body 12, and the valve body 12 rises. At this time, the out-port for valve control 46 is blocked from the in-port for valve control 41 by the large-diameter portion 3*a* of the piston 3.

Figure 8:
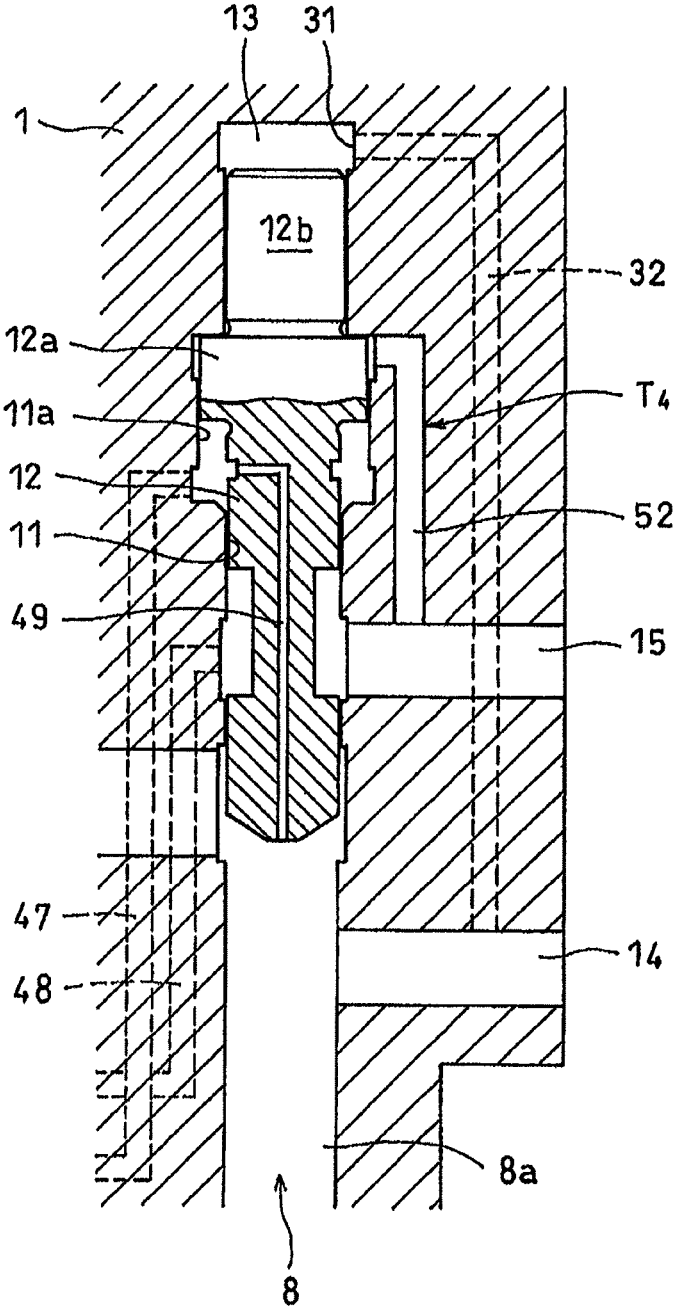
FIG. 8 is a sectional view showing a switching state of the switching valve.

FIG. 8 shows the state where the valve body 12 has risen, and the rise of the valve body 12 causes the lower end portion of the valve body 12 to come out of the communication path 8 through the vertical hole 8*a*, so that the communication path 8 is opened, thereby allowing the lower chamber 5, the communication path 8, and the upper chamber 6 to be kept in communication with one another so as to have equal pressure. Then, the piston 3 descends due to the accumulated pressure energy of the high-pressure gas in the gas chamber 7 which has been compressed by the rise of the piston 3 so as to strike the chisel 2.

When the piston 3 descends, the communication between the lower chamber 5 and the in-port for valve control 41 is blocked, and the supply to the pressure oil to the large-diameter chamber 11*a* is blocked, so that the oil passage for valve rise 47 is connected via the out-port for valve control 46 to the oil supply passage for valve descent 48 communicating with the oil discharge opening 15. Therefore, the valve body 12 is pressed downward by the pressure oil that flows from the pressure applying passage T2 communicating with the oil supply opening 14 into the valve regulating chamber 13 so as to descend, so that the lower end portion of the valve body 12 enters the communication path 8 to block the communication between the lower chamber 5 and the upper chamber 6, as shown in FIG. 7. Thereafter, the above-described motions are repeated.

The oil passing hole 49 allows the supply of an oil for keeping the valve body 12 at the raised position during the rise of the valve body to the large-diameter chamber 11*a*.

As described above, the impact-driven tool of the one embodiment and the other embodiment employs a configuration in which the impact-driven tool includes: a cylinder 1 having an elongated shape from its upper end to its lower end and opening on the lower end side; a chisel 2 having an upper end portion that is slidably inserted into the lower end portion of the cylinder 1; and a piston 3 that is incorporated in the cylinder 1 so as to be slidable in the axial direction and that has a large-diameter portion 3*a* at an intermediate position between its upper end portion and its lower end portion in the axial direction to strike the chisel 2 with the lower end portion, wherein the cylinder 1 includes: an upper chamber 6 that is a space defined by an outer surface of the piston 3 located more on the upper end side in the axial direction than the large-diameter portion 3*a* of the piston 3 and an inner surface of the cylinder 1; a lower chamber 5 that is a space defined by an outer surface of the piston 3 located more on the lower end side in the axial direction than the large-diameter portion 3*a* of the piston 3 and an inner surface of the cylinder 1; a gas chamber 7 in which a high-pressure gas is encapsulated on the upper end surface side in the axial direction of the piston 3; a communication path 8 that allows the upper chamber 6 and the lower chamber 5 to communicate with each other; a valve chamber 11 that is continuous with the upper end side in the axial direction of the communication path 8; and a valve regulating chamber 13 provided on the upper end side in the axial direction of the valve chamber 11, the impact-driven tool includes a valve body 12 that is provided for opening and closing control of the communication path 8 and that is slidably incorporated in the valve chamber 11, in which a large-diameter portion 12*a* that is slidable in the axial direction within a large-diameter chamber 11*a* that is a space on the upper end side in the axial direction of the valve chamber 11 is formed on the upper end side in the axial direction, the cylinder 1 includes: an oil supply passage for piston rise T1 that introduces a pressure oil from an oil supply opening 14 to the communication path 8 when the valve body 12 is located at a lowered position on the lower end side in the axial direction; a pressure applying passage T2 that guides the pressure oil from the oil supply opening 14 to the valve regulating chamber 13 so as to apply an oil supply pressure onto the upper end surface in the axial direction of the valve body 12; a valve switching control oil passage T3 that raises the valve body 12 when the piston 3 is in the state just before it reaches the upper limit position that is the movement limit position on the upper end side in the axial direction by introducing the pressure oil to a bottom part that is a part on the lower end side in the axial direction of the large-diameter chamber 11*a* during the rising process in which the piston 3 moves from the lower end side to the upper end side in the axial direction; and an oil discharge passage T4 that allows a part on the upper end side in the axial direction of the large-diameter chamber 11*a* and the oil discharge opening 15 to communicate with each other in a lowered state where the valve body 12 has moved to the lower end side in the axial direction, the communication path 8 has a vertical hole 8*a* extending in the axial direction, the vertical hole 8*a* has an upper end portion in the axial direction through which the lower end portion in the axial direction of the valve body 12 that reciprocates within the valve chamber 11 is movable back and forth, and entry of the lower end portion of the valve body 12 into the upper end portion of the vertical hole 8*a* produces a closed state where the communication between the upper chamber 6 and the lower chamber 5 is blocked.

In the impact-driven tool having the above-described configuration, upon the supply of the pressure oil to the oil supply opening 14 when the valve body 12 is lowered so that the lower end portion of the valve body 12 enters the vertical hole 8*a* of the communication path 8 to block the communication between the lower chamber 5 and the upper chamber 6, the pressure oil flows from the oil supply passage for piston rise T1 through the communication path 8 into the lower chamber 5, so that the piston 3 rises to compress the high-pressure gas in the gas chamber 7.

When the piston 3 has risen to a position just before it reaches the upper limit position in the rising process of the piston 3, the pressure oil is introduced into the lower part of the large-diameter chamber 11*a* through the valve switching control oil passage T3, and the valve body 12 is raised by the pressure oil, so that the lower end portion of the valve body 12 comes out of the communication path 8 through the vertical hole 8*a*, and the expansion of the compressed high-pressure gas in the gas chamber 7 causes the piston 3 to descend and strike the chisel 2. At this time, the pressure oil in the lower chamber 5 flows into the upper chamber 6 via the communication path 8 that is open.

Further, the descent of the piston 3 blocks the communication between the lower chamber 5 and the valve switching control oil passage T3 to block the supply of the pressure oil to the lower part of the large-diameter chamber 11*a*, and the lower part of the large-diameter chamber 11*a* communicates with the oil discharge opening 15 to allow the discharge of the pressure oil in the upper chamber 6 and the lower part of the large-diameter chamber 11*a* through the oil discharge opening 15. Further, since the pressure oil is supplied from the oil supply opening 14 to the valve regulating chamber 13 through the pressure applying passage T2, the valve body 12 descends. The descent allows the lower end portion of the valve body 12 to enter the vertical hole 8*a* of the communication path 8 to close the communication path 8, thereby blocking the communication between the lower chamber 5 and the upper chamber 6. Thereafter, the above-described motions are repeated.

As described above, the valve body 12 opens and closes the communication path 8 by its upward and downward movement. When the communication path 8 is opened, the communication path 8 allows the lower chamber 5 and the upper chamber 6 to communicate with each other so as to allow the hydraulic oil in the lower chamber 5 to flow into the upper chamber 6, which eliminate the need to form a constricted portion such as an annular groove for allowing the hydraulic oil in the lower chamber 5 to flow into the upper chamber 6 in the valve body 12, so that the axial length of the valve body 12 can be shortened.

Further, the hydraulic oil in the lower chamber 5 smoothly flows from the communication path 8 to the upper chamber 6 without passing through such a constricted portion in the valve body since the flow channels are allowed to have sufficient diameter, and the valve body 12 does not cause a resistance to the flow of the hydraulic oil, so that the diameter of the valve body 12 can be reduced. In this way, while the weight of the valve body 12 is reduced by the reduction in length and diameter of the valve body 12, the conduits of the hydraulic oil can be maintained.

Further, the reduction in length of the valve body 12 can reduce the lifting stroke of the valve body 12, and the light weight can facilitate the control of the valve body 12. Further, being different from a structure that uses a hollow hole of the valve body 12 as a flow channel, the valve body 12 can have a small diameter, and therefore a reduction in efficiency due to oil leakage during actuation can be suppressed, so that the striking efficiency can be improved.

Further, when the piston 3 strikes the chisel 2, and the recoil thereof causes the piston 3 to instantaneously rise, thereby causing the hydraulic oil in the upper chamber 6 to flow toward the lower chamber 5, the valve body 12 is located still at the raised position, and the hydraulic oil directly reaches the lower chamber through the communication path 8. Therefore, as compared with conventional types in which the hydraulic oil passes through the inside of the valve body, the valve body 12 is not affected by the flow of the hydraulic oil, so that the striking by the piston 3 can be stabilized.

Further, in the impact-driven tool according to the one embodiment and the other embodiment, the oil supply passage for piston rise T1 may include: an annular high-pressure in-port 21 formed in the inner circumference of the valve chamber 11 to communicate with the oil supply opening 14; an annular high-pressure out-port 22 that communicates with the high-pressure in-port 21 via a constricted portion 16 formed in the valve body 12, in the lowered state of the valve body 12; and a bypass passage 23 that allows the high-pressure out-port 22 and an intermediate portion in the axial direction of the communication path 8 to communicate with each other. In this case, the valve switching control oil passage T3 may include: an annular in-port for valve control 41 formed in the inner circumference of the cylinder 1 between the lower chamber 5 and the upper chamber 6, so as to communicate with the lower chamber 5 when the piston 3 is located at a position just before it reaches the upper limit position; and an oil passage for valve rise 47 having one end communicating with the in-port for valve control 41 and the other end communicating with the bottom part of the large-diameter chamber 11*a* of the valve chamber 11.

Further, the configuration may be such that the oil supply passage for piston rise T1 includes an inlet side passage 25 having an open end serving as the oil supply opening 14, and the valve switching control oil passage T3 includes: an annular in-port for valve control 41 formed in the inner circumference of the cylinder 1 between the lower chamber 5 and the upper chamber 6, so as to communicate with the lower chamber when the piston 3 is located at a position just before it reaches the upper limit position; an out-port for valve control 46 formed at an interval more on the upper end side in the axial direction than the in-port for valve control 41, so as to communicate with the in-port for valve control 41 via the annular groove for valve switching 45 formed in the large-diameter portion 3*a* of the piston 3 in a lowered state in which the piston 3 has moved to the lower end side in the axial direction; an oil passage for valve rise 47 having one end communicating with the in-port for valve control 41 and the other end communicating with the out-port for valve control 42 in the bottom part of the large-diameter chamber 11*a* of the valve chamber 11; an oil supply passage for valve descent 48 having one end communicating with the out-port for valve control 46 and the other end constantly communicating with the oil discharge opening 15 via the constricted portion 16 formed in the valve body 12; and an oil passing hole 49 formed in the valve body 12 so as to allow a part on the lower end side of the large-diameter chamber 11*a* of the valve chamber 11 and the communication path 8 to communicate with each other in a raised state in which the valve body 12 has moved to the upper end side in the axial direction.

Here, the constricted portion 16 formed in the valve body 12 may be an annular groove or a plurality of cutouts formed at intervals in the circumferential direction. When the plurality of cutouts serve as the constricted portion 16, the outer circumferences between adjacent cutouts form sliding guide surfaces, and therefore the valve body 12 can be smoothly moved up and down within the valve chamber 11.

Accordingly, in the one embodiment and the other embodiment, the communication path 8 that allows the lower chamber 5 and the upper chamber 6 to communicate with each other is opened and closed by the valve body 12 that moves up and down within the valve chamber 11, and the hydraulic oil (pressure oil) in the lower chamber 5 is allowed to flow into the upper chamber 6 when the communication path 8 is open, as described above, which can therefore eliminate the need to form a constricted portion such as a plurality of annular grooves through which the hydraulic oil in the lower chamber 5 flows into the upper chamber 6 in the valve body 12, so that the axial length of the valve body 12 can be shortened. Moreover, as compared with the case of using the inner diameter of a cylindrical valve body as a flow channel, the valve body does not cause a resistance, and sufficient flow channels are maintained, when the hydraulic oil (pressure oil) flows from the lower chamber 5 to the upper chamber 6. Therefore, the diameter of the valve body 12 can be reduced, and the conduits of the hydraulic oil can be maintained while the weight of the valve body 12 is reduced by the reduction in length and diameter of the valve body 12.

Further, the upper chamber 6 and the lower chamber 5 are directly connected by the communication path 8 without using annular grooves or inside flow channels, thereby allowing the hydraulic oil (pressure oil) to instantaneously move therebetween, which therefore eliminates the resistance when the piston 3 descends, so that the striking is smoothly performed. Further, the size of the cylinder 1 itself housing the valve body 12 can be also reduced, and the weight of the impact-driven tool itself can be also reduced.

The impact-driven tool according to the present invention is not limited to the above-described embodiments, and various modifications can be made without departing from the gist of the present invention.

For example, the case where the axial direction has the same meaning as the vertical direction is described in the above-described embodiments, but there is no limitation to this. The axial direction can have the same meaning as the left-right direction (horizontal direction) or a direction inclined to the horizon.

Figure 9:
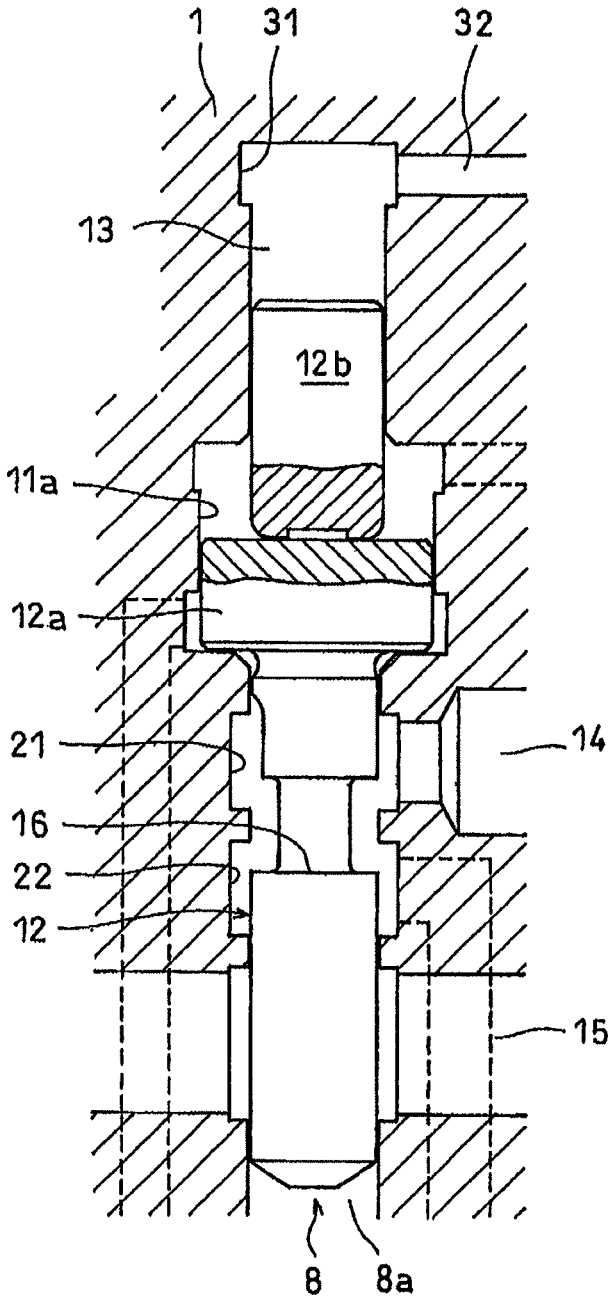
FIG. 9 is a front view showing another example of the valve body.

Further, in the above-described embodiments, the case where the plunger 12*b* of the valve body 12 is configured integrally with the large-diameter portion 12*a* is described, but there is no limitation to this. The plunger 12*b* may be divided from the valve body 12, with the upper surface of the large-diameter portion 12*a* serving as a dividing surface, as shown in FIG. 9. Specifically, the large-diameter portion 12*a* and the plunger 12*b* may be configured as separate bodies from each other in the valve body 12. This eliminates the need to obtain the coaxiality of the sliding portion of the valve body 12 and the sliding portion of the plunger 12*b*, and therefore processing the valve chamber 11 and the valve body 12 can be facilitated.

Figure 10:
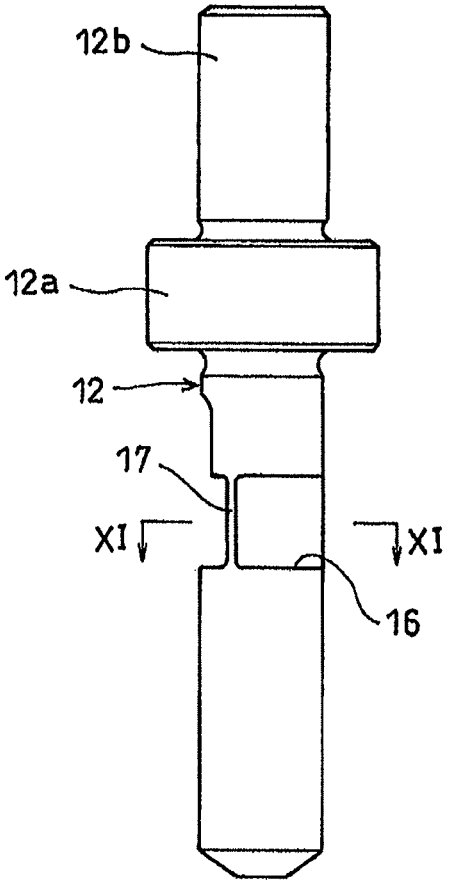
FIG. 10 is a sectional view showing still another example of the valve body.
Figure 11A:
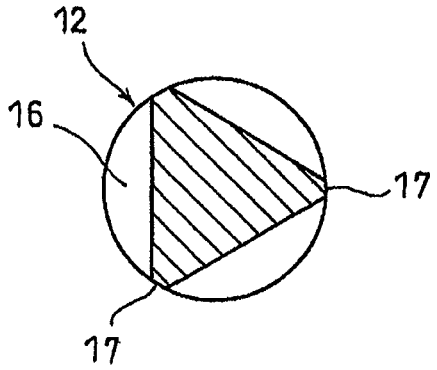
FIG. 11A is a sectional view taken along the line XI-XI in FIG. 10.

Further, in the above-described embodiments, the case where the constricted portion 16 of the valve body 12 is constituted by an annular groove, as shown in FIG. 2, is described, but there is no limitation to this. The constricted portion 16 may be constituted by a plurality of cutouts formed at intervals in the circumferential direction, as shown in FIG. 10 and FIG. 11A. In this case, the outer circumferences between the constricted portions 16 provided as adjacent cutouts form sliding guide surfaces 17, and therefore the valve body 12 can be smoothly moved up and down within the valve chamber 11.

Figure 11B:
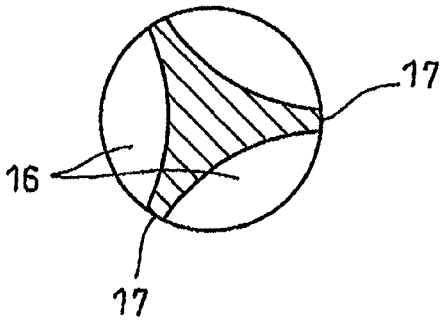
FIG. 11B is a sectional view showing another example of a constricted portion.

In this regard, the side surfaces of the constricted portion 16 constituted by the cutouts may be formed as concave curved surfaces, as shown in FIG. 11B.

Figure 12A:
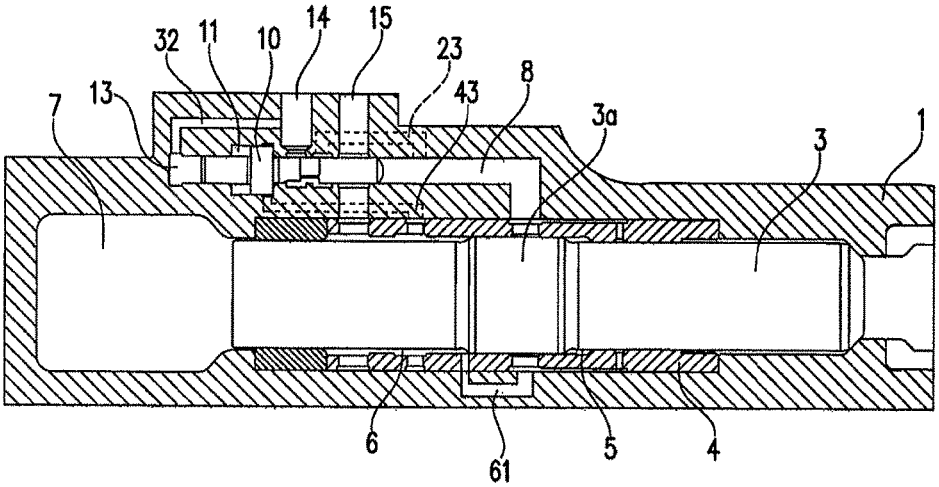
FIG. 12A is a vertical sectional view showing the other embodiment of the impact-driven tool according to the present invention.

Further, as shown in FIG. 12A, a bypass passage for blank shot prevention 61 configured to prevent blank shots may be provided (FIG. 12A shows a horizontally laid state). The "blank shots" mean that the upward and the downward movement of the piston 3 continues in the state where the tip of the chisel 2 is disengaged from the target object such as a concrete structure, so that the chisel 2 is lowered. In this case, when the piston 3 does not strike the chisel 2, and the lower end portion of the piston 3 collides with the inner surface of the cylinder 1, the cylinder 1 may be damaged, which is not desirable.

The bypass passage for blank shot prevention 61 is an oil passage that allows the opposite side of the communication path 8 and the upper chamber 6 to communicate with each other, as shown in the figure. The bypass passage for blank shot prevention 61 allows the pressure oil supplied from the communication path 8 to come out into the upper chamber 6 through the bypass passage for blank shot prevention 61 so as to flow into the oil discharge opening 15 to be discharged. Therefore, the oil pressure for rise can be prevented from being applied to the piston 3, so that the blank shots are prevented. The opening position of the bypass passage 61 is not limited to the opposite side of the communication path 8, and may be a position that does not overlap with the communication path 8.

Figure 12B:
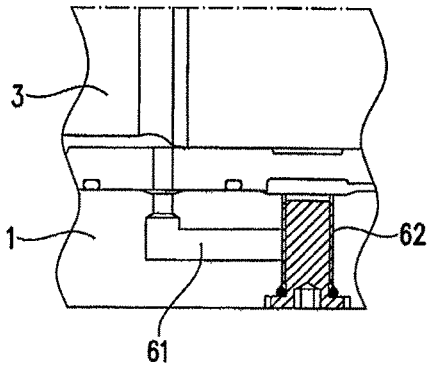
FIG. 12B is an enlarged view of a main part of the other embodiment of the impact-driven tool according to the present invention.
Figure 12C:
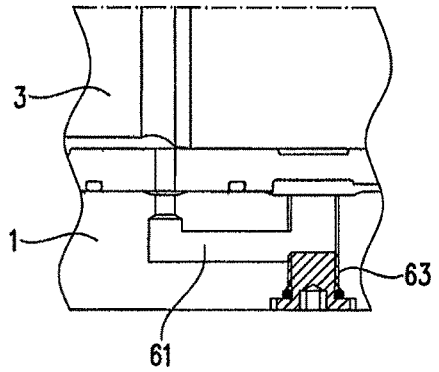
FIG. 12C is an enlarged view of a main part of the other embodiment of the impact-driven tool according to the present invention.

Some users of the impact-driven tool may desire specification in which the blank shots are not prevented in some cases. Therefore, as shown in FIG. 12B, a configuration in which the blank shots are not prevented can be achieved by arranging a plug 62 that can be fixed to the cylinder 1 by screwing to close the bypass passage for blank shot prevention 61. On the other hand, as shown in FIG. 12C, the blank shots can be prevented by using a short plug 63 having a small dimension in the axial direction, instead of the plug 62, so as not to close the bypass passage for blank shot prevention 61.

Figure 12D:
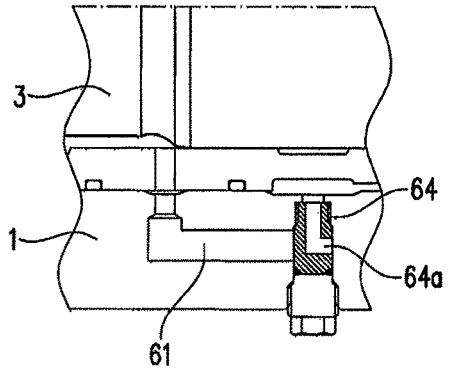
FIG. 12D is an enlarged view of a main part of the other embodiment of the impact-driven tool according to the present invention.
Figure 12E:
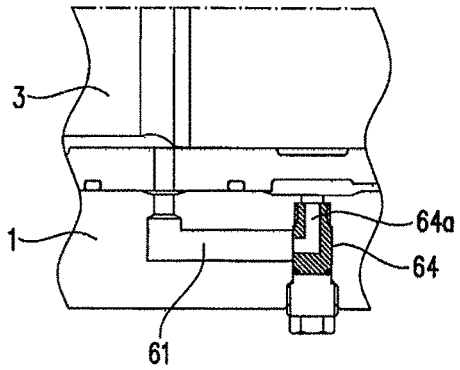
FIG. 12E is an enlarged view of a main part of the other embodiment of the impact-driven tool according to the present invention.

Likewise, a hollow plug 64 internally having an oil passing hole 64*a* also can be used. In the case of using the hollow plug 64, a configuration to close the bypass passage for blank shot prevention 61, as shown in FIG. 12D, or a configuration not to close the bypass passage for blank shot prevention 61, as shown in FIG. 12E, can be achieved by changing the mounting state on the cylinder 1.

REFERENCE SIGNS LIST

1: Cylinder
2: Chisel
3: Piston
5: Chamber on the other end side, lower chamber
6: Chamber on one end side, upper chamber
7: Gas chamber
8: Communication path
8*a:* Vertical hole
11: Valve chamber
11*a:* Large-diameter chamber
12: Valve body
12*a:* Large-diameter portion
13: Valve regulating chamber
14: Oil supply opening
15: Oil discharge opening
16: Constricted portion
T1: Oil supply passage for piston movement in one direction, Oil supply passage for piston rise
21: High pressure in-port
22: High pressure out-port
23: Bypass passage
25: Inlet side passage
T2: Pressure applying passage
T3: Valve switching control oil passage
41: In-port for valve control
42: Out-port for valve control
43: Oil passage for valve movement in one direction, Oil passage for valve rise
45: Annular groove
46: Out-port for valve control
47: Oil passage for valve movement in one direction, Oil passage for valve rise
48: Oil passage for valve movement in the other direction, Oil supply passage for valve descent
49: Oil passing hole
T4: Oil discharge passage
51: Oil discharge port
52: Oil discharge hole

The invention claimed is:

1. An impact-driven tool, comprising:

a cylinder that has an elongated shape from one end to the other end and that is open on the other end side;

a chisel having one end portion that is slidably inserted into the other end portion of the cylinder; and a piston that is incorporated in the cylinder so as to be slidable in the axial direction and that has a large-diameter portion at an intermediate position between its one end portion and the other end portion in the axial direction to strike the chisel with the other end portion, wherein the cylinder comprises:

a chamber on one end side that is a space defined by an outer surface of the piston located more on the one end side in the axial direction than the large-diameter portion of the piston and an inner surface of the cylinder;

a chamber on the other end side that is a space defined by an outer surface of the piston located more on the other end side in the axial direction than the large-diameter portion of the piston and an inner surface of the cylinder;

a gas chamber in which a high-pressure gas is encapsulated on the one end surface side in the axial direction of the piston;

a communication path that allows the chamber on one end side and the chamber on the other end side to communicate with each other;

a valve chamber that is continuous with one end side in the axial direction of the communication path; and a valve regulating chamber provided on one end side in the axial direction of the valve chamber, the impact-driven tool comprises a valve body that is provided for opening and closing control of the communication path, that is slidably incorporated in the valve chamber, in which a large-diameter portion that is slidable in the axial direction within a large-diameter chamber that is a space on the one end side in the axial direction of the valve chamber is formed on the one end side in the axial direction, and the valve body not being hollow to provide a flow channel, the cylinder comprises:

an oil supply passage for piston movement in one direction that introduces a pressure oil from an oil supply opening to the communication path when the valve body is located at a position on the other end side in the axial direction;

a pressure applying passage that guides the pressure oil from the oil supply opening to the valve regulating chamber so as to apply an oil supply pressure onto the one end surface in the axial direction of the valve body;

a valve switching control oil passage that moves the valve body when the piston is in a state just before it reaches a movement limit position on the one end side in the axial direction by introducing the pressure oil to a bottom part that is a part on the other end side in the axial direction of the large-diameter chamber during a process in which the piston moves from the other end side to the one end side in the axial direction; and an oil discharge passage that allows the one end side in the axial direction of the large-diameter chamber and an oil discharge opening to communicate with each other when the valve body has moved to the other end side in the axial direction, the communication path has a vertical hole extending in the axial direction and extending so as to coincide with the direction of the slide of the valve body, the vertical hole has one end in the axial direction through which the other end portion in the axial direction of the valve body that reciprocates within the valve chamber is movable back and forth, entry of the other end of the valve body into the one end portion of the vertical hole produces a closed state where the communication between the chamber on one end side and the chamber on the other end side is blocked, and coming out of the other end portion of the valve body from the one end portion of the vertical hole allows the chamber on the other end side to communicate with the oil discharge opening through the communication path without passing through the inside of the valve body.

2. The impact-driven tool according to claim 1, wherein the oil supply passage for piston movement in one direction comprises:

an annular high-pressure in-port formed in the inner circumference of the valve chamber to communicate with the oil supply opening;

an annular high-pressure out-port that communicates with the high-pressure in-port via a constricted portion formed in the valve body, when the valve body has moved to the other end side in the axial direction; and a bypass passage that allows the high-pressure out-port and an intermediate portion in the axial direction of the communication path to communicate with each other, and allows the total amount of the pressure oil to be introduced from the oil supply passage for piston movement in one direction to the communication path to flow therethrough in the closed state, and the valve switching control oil passage comprises:

an annular in-port for valve control formed in the inner circumference of the cylinder between the chamber on one end side and the chamber on the other end side, so as to communicate with the chamber on the other end side when the piston is located at a position just before it reaches the movement limit position on the one end side in the axial direction; and an oil passage for valve movement in one direction having one end communicating with the in-port for valve control and the other end communicating with the bottom part of the large-diameter chamber of the valve chamber.

3. An impact-driven tool, comprising:

a cylinder that has an elongated shape from one end to the other end and that is open on the other end side;

a chisel having one end portion that is slidably inserted into the other end portion of the cylinder; and a piston that is incorporated in the cylinder so as to be slidable in the axial direction and that has a large-diameter portion at an intermediate position between its one end portion and the other end portion in the axial direction to strike the chisel with the other end portion, wherein the cylinder comprises:

a chamber on one end side that is a space defined by an outer surface of the piston located more on the one end side in the axial direction than the large-diameter portion of the piston and an inner surface of the cylinder;

a chamber on the other end side that is a space defined by an outer surface of the piston located more on the other end side in the axial direction than the large-diameter portion of the piston and an inner surface of the cylinder;

a gas chamber in which a high-pressure gas is encapsulated on the one end surface side in the axial direction of the piston;

a communication path that allows the chamber on one end side and the chamber on the other end side to communicate with each other;

a valve chamber that is continuous with one end side in the axial direction of the communication path; and a valve regulating chamber provided on one end side in the axial direction of the valve chamber, the impact-driven tool comprises a valve body that is provided for opening and closing control of the communication path, and that is slidably incorporated in the valve chamber, in which a large-diameter portion that is slidable in the axial direction within a large-diameter chamber that is a space on the one end side in the axial direction of the valve chamber is formed on the one end side in the axial direction, the cylinder comprises:

an oil supply passage for piston movement in one direction that introduces a pressure oil from an oil supply opening to the communication path when the valve body is located at a position on the other end side in the axial direction;

a pressure applying passage that guides the pressure oil from the oil supply opening to the valve regulating chamber so as to apply an oil supply pressure onto the one end surface in the axial direction of the valve body;

a valve switching control oil passage that moves the valve body when the piston is in a state just before it reaches a movement limit position on the one end side in the axial direction by introducing the pressure oil to a bottom part that is a part on the other end side in the axial direction of the large-diameter chamber during a process in which the piston moves from the other end side to the one end side in the axial direction; and an oil discharge passage that allows the one end side in the axial direction of the large-diameter chamber and an oil discharge opening to communicate with each other when the valve body has moved to the other end side in the axial direction, the communication path has a vertical hole extending in the axial direction and extending so as to coincide with the direction of the slide of the valve body, the vertical hole has one end in the axial direction through which the other end portion in the axial direction of the valve body that reciprocates within the valve chamber is movable back and forth, entry of the other end of the valve body into the one end portion of the vertical hole produces a closed state where the communication between the chamber on one end side and the chamber on the other end side is blocked, and coming out of the other end portion of the valve body from the one end portion of the vertical hole allows the chamber on the other end side to communicate with the oil discharge opening through the communication path without passing through the inside of the valve body, wherein the oil supply passage for piston movement in one direction comprises an inlet side passage having an open end serving as the oil supply opening, and the valve switching control oil passage comprises:

an annular in-port for valve control formed in the inner circumference of the cylinder between the chamber on one end side and the chamber on the other end side, so as to communicate with the chamber on the other end side when the piston is located at a position just before it reaches the movement limit position on the one end side in the axial direction; and an out-port for valve control formed at an interval more on the one end side in the axial direction than the in-port for valve control, so as to communicate with the in-port for valve control via an annular groove for valve switching formed in the large-diameter portion of the piston when the piston has moved to the other end side in the axial direction;

an oil passage for valve movement in one direction having one end communicating with the in-port for valve control and the other end communicating with the bottom part of the large-diameter chamber of the valve chamber;

an oil passage for valve movement in the other direction having one end communicating with the out-port for valve control and the other end constantly communicating with the oil discharge opening via a constricted portion formed in the valve body; and an oil passing hole formed in the valve body so as to allow the part on the other end side of the large-diameter chamber of the valve chamber and the communication path to communicate with each other when the valve body has moved to the one end side in the axial direction.

4. The impact-driven tool according to claim 2, wherein the constricted portion formed in the valve body is an annular groove or a plurality of cutouts formed at intervals in the circumferential direction.

5. The impact-driven tool according to claim 3, wherein the constricted portion formed in the valve body is the annular groove or a plurality of cutouts formed at intervals in the circumferential direction.

* * * * *